United States Patent [19]

Daniels

[11] Patent Number: 4,518,198

[45] Date of Patent: May 21, 1985

[54] LAWN FURNITURE COVERING

[75] Inventor: Jean G. Daniels, Richmond, Va.

[73] Assignee: William Jay Monahan, Richmond, Va. ; a part interest

[21] Appl. No.: 294,994

[22] Filed: Aug. 21, 1981

[51] Int. Cl.[3] ..... A47C 31/10

[52] U.S. Cl. ..... 297/229; 297/118

[58] Field of Search ..... 297/219, 229, 118, 228, 297/188, 17

[56] References Cited

U.S. PATENT DOCUMENTS

| | | | |
|---|---|---|---|
| 119,162 | 9/1871 | Lutz | 297/17 X |
| 337,715 | 3/1886 | Tietze | 297/17 |
| 2,254,466 | 9/1941 | Albert | 297/228 X |
| 2,797,743 | 7/1957 | Rodtz | 297/229 |
| 3,078,101 | 2/1963 | Reese | 297/228 X |
| 3,151,909 | 10/1964 | Gerdetz | 297/188 |
| 3,475,050 | 10/1969 | Leahy | 297/17 |
| 3,902,753 | 9/1975 | Wilson | 297/219 |
| 4,188,065 | 2/1980 | Meeker | 297/219 |
| 4,273,221 | 6/1981 | Poag | 297/118 |
| 4,273,380 | 6/1981 | Silvestri | 297/229 |

*Primary Examiner*—Francis K. Zugel

[57] ABSTRACT

A cloth covering for lawn furniture which attaches to the furniture and converts into a container to carry beach paraphenalia and other articles to include the lawn furniture. Pockets are included which are accessible when the covering is spread over lawn furniture either having or lacking arm rests.

9 Claims, 9 Drawing Figures

LAWN FURNITURE COVERING

BACKGROUND OF THE INVENTION

Sunbathers using conventional lawn furniture often cover this furniture with a beach towel to absorb perspiration and the usual oils and other ointments and to alleviate the heat absorbing ability of the coverings used in constructing the furniture. This practice has drawbacks in that the towel often blows off the chair or wraps around the sun worshipper and becomes an addition to the many and various items believed to be a requirement for a well-prepared beach or pool visitor. Particularly for the family with young children, but for others as well, a trip to the beach or pool requires a separate container for all the many items that might be needed.

The present invention provides a cloth lawn furniture covering which attaches to the chair or cot and which may be converted to a container to hold all the many items taken to the beach or pool and, in fact, may be used to carry the lawn furniture. This covering is provided with pockets to protect items from contamination by sand and other elements.

Accordingly it is an object of the invention to provide a lawn furniture covering which can be attached to the furniture and converted to a container before and after its use as a covering.

It is a further object of the invention to provide a covering which includes pockets accessible to one sitting or reclining upon the lawn furniture, to contain useful items and to protect them from sun, sand, salt air, water and other elements.

The novel covering may include an absorbent side, an aluminized reflective side and a durable, protective side in any combination. Some variations of the invention would be washable, and all could be cleaned.

The converted container may include a strap to permit over-the-shoulder carrying and stiffening rods to provide shape for the covering when used as a container.

SUMMARY OF THE INVENTION

This invention relates to a covering for lawn furniture, which is defined to mean, whether that term is used herein, light-weight, portable folding chairs for sitting or reclining, usually out of doors, and including the chaise lounge and bi-fold chair with arm rests and cot-like or chaise lounges which may be folded flat and which have no arm rests.

The preferred embodiment includes a two-ply cloth covering generally conforming to the back, seat and other supportive surfaces of the lawn furniture, one ply being of an absorbent material such as terry cloth and one ply of durable material such as cotton duck. Elastic straps or pockets at the ends of this conformal covering are used to secure it to the lawn furniture; and two ear-like pieces, containing pockets, are attached to the conformal covering in the area of the section covering the furniture seat. These two ear-like pieces may hang over the chair arms, if any, and they may be foreshortened by fasteners if the furniture has no arms, and give the complete covering a cross-like appearance.

Extending from the four corner intersections of the conformal covering and the two ear-like pieces are zippers or other fastenings which can be zipped or fastened to convert the covering into a container. These zippers or other fastenings extend equidistantly along the edges of the cloth to a length equal to the depth of the container, the other dimensions of which are determined by the widths of the conformal covering and of the ear-like pieces.

A carrying strap may be attached to the durable ply material at points beyond the area of the extension of the zippers or other fastenings. Stiffening rods may be sewn into the juncture between the ear-like pieces and the conformal covering to add stiffness and shape to the covering when being used as a container.

DETAILED DESCRIPTION

Figure 1:
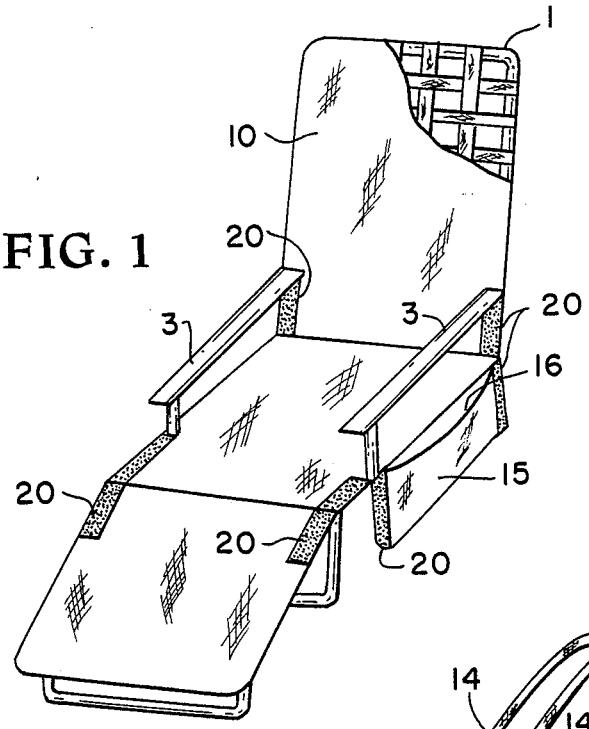
FIG. 1 is a perspective plan view, partially cutaway, of the novel covering attached to a chaise lounge having arm rests.

Referring now to the drawings, FIG. 1 shows the novel covering 10 fitting over chaise lounge 1, conventionally constructed. As shown, 10 represents the absorbent or reflective side of the covering. Pockets 15 having openings 16 hang down below the arms 3 of the chair 1 and do not, in the version shown, cover the arms. Fasteners 20 attached to the covering are used to form the container 60 shown in FIG. 2

Figure 2:
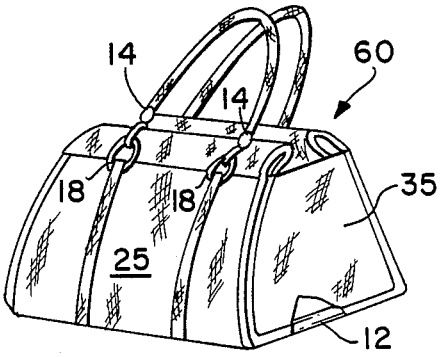
FIG. 2 is a perspective plan view, partially cutaway, of the container formed from this novel covering.
Figure 3:
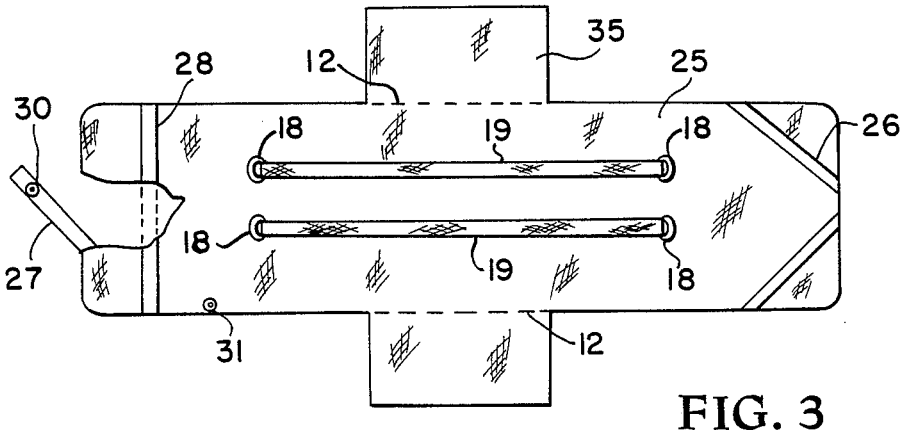
FIG. 3 is a plan view of the durable side of the covering.

FIG. 2. and FIG. 3 show the durable side 25 of the covering. Strapping strips 19 are sewn to this durable material 25 and rings 18 are sewn to the ends of strips 19. Straps 17 may be attached to rings 18 by ring snaps 14. Stiffening rods 12 may be sewn along the fold line of the pockets to hold the shape of container 60. The durable side of each of the pockets is denoted by 35 in FIGS. 2 and 3.

Diagonal elastic straps 26 may be sewn to the sides and ends of covering 25 to fit over the chair back to hold the covering in place. Other means of securing the chair include an elastic loop 28 sewn to the sides of 25, a diagonal strap 27 sewn to 25 and snapped thereto by male and female snap connectors 30 and 31, and a pocket of durable material (not shown) which would fit over the end of the chair.

Figure 4:
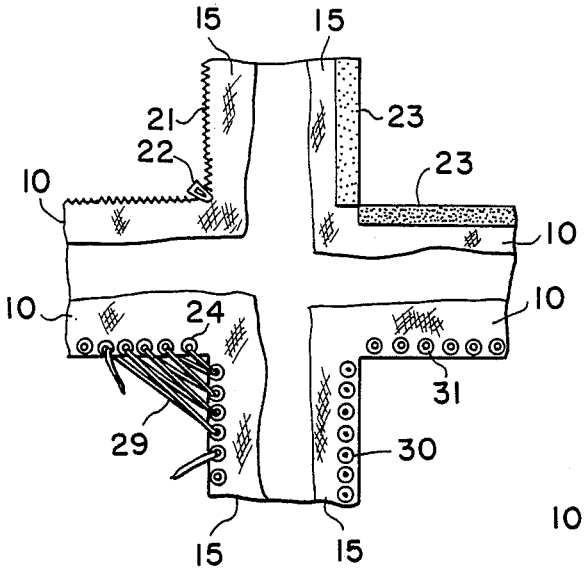
FIG. 4 is a schematic plan view of the fastenings used to convert the covering to a container.

FIG. 4 illustrates a few of the many fasteners which may be used to convert the covering to container 60. Plastic zippers including plastic beaded edges 21 and slide 22 may be used as may a suitable loop and hook fabric known commercially as VELCRO 23, male/-female snaps 30 and 31 or eyelets 24 and laces 29.

Figure 5A:
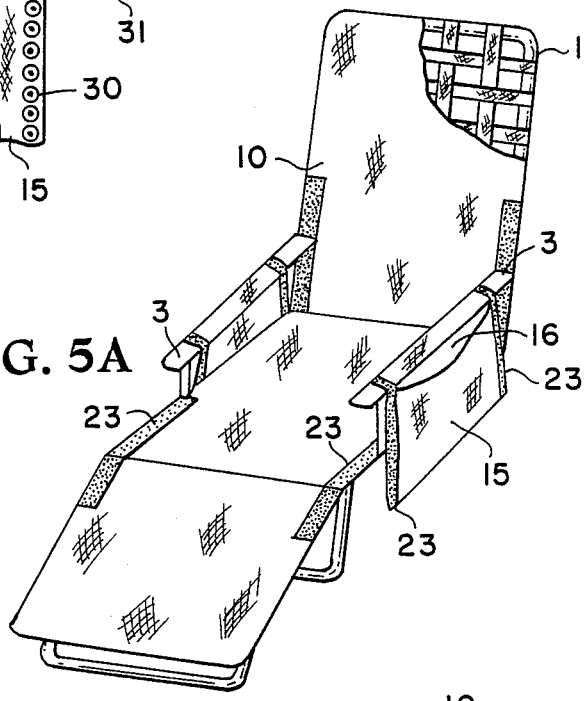
FIG. 5A is a perspective plan view, partially cutaway, of a pocket panel hanging over the arms of a chair
Figure 5B:
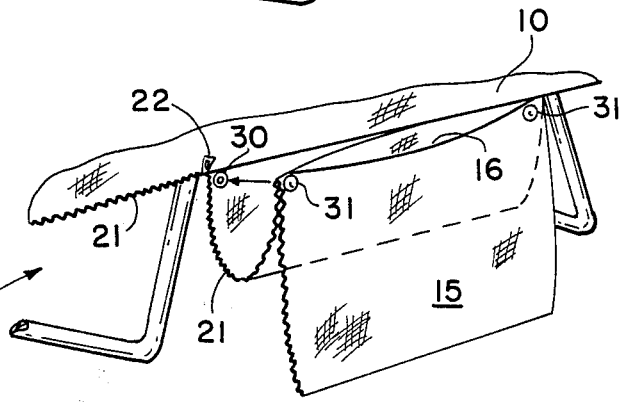
FIG. 5B is a perspective view of this pocket, foreshortened to hang properly on an armless folding chair.

A larger container may be formed when the side pockets 15 hang over the arms 3 of chair 1 as shown in FIG. 5A. The extra material needed to allow pockets 15 to hang in this fashion may be gathered as shown in FIG. 5B and snapped by male/female snaps 30 and 31 when covering 10 is used with a cot-type armless chair 5.

By making the covering oversize, the chair itself may be contained. FIG. 7 shows a covering having a back area 45 and seat area 40 with pockets 15 hanging over the arms 3 of a bi-fold chair 50. Excess material 52 and 47 along the sides and hanging over the back of chair 50 insures that the dimensions X and Y shown in FIG. 6 exceed the dimensions of the folded chair 50 shown carried in the formed container in FIG. 8.

Figure 6:
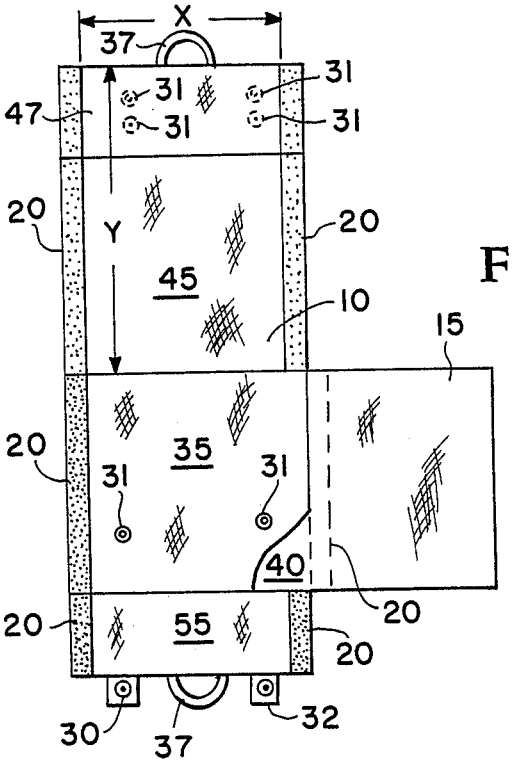
FIG. 6 is a plan view, partially cutaway, of an alternate embodiment of the covering as used to cover and to contain a bi-fold chair.
Figure 7:
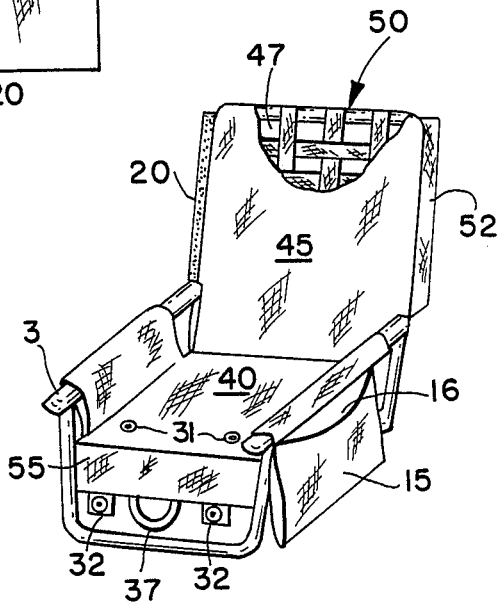
FIG. 7 is a perspective view, partially cutaway, of the covering on the bi-fold chair.
Figure 8:
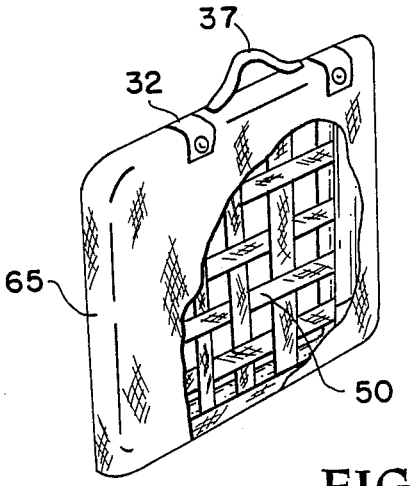
FIG. 8 is a plan view, partially cutaway, to show the bi-fold chair being carried in the alternate embodiment of the covering shown in FIGS. 6 and 7.

FIG. 6 shows that the fasteners 20 are attached to the durable side 35 of the pockets which are folded over on seat area 40 (and folded over items to be contained) before assembling the container 65. The back area 45 includes excess material 47 which folds over the back of chair 50 and excess panel 55 which may be folded under the chair seat and snapped by tabs 32 and male/female snaps 30 and 31. The extra material makes the container 65 large enough to contain the chair as shown. Handles 37 make carrying easier and tabs 32 also serve to hold the container together at its top as shown in FIG. 8.

Many materials may be used in the construction of the invention. The side 10 of the covering can be an absorbent material such as terry cloth or cotton toweling or it can be cloth or plastic with an aluminized reflective coating of a type used to tan evenly. Side 25 may be any sturdy fabric with natural body such as denium, canvas, duck cloth, quilted plastic, bonded plastic or burlap and other natural fiber materials. While two ply construction is suggested, one ply construction is also possible with a variety of fabrics.

Rust resistance is important in construction and that is why plastic zippers are suggested when metal would also serve. The rings 18 and stiffening rods 12 may be of plastic, aluminum or wood. Strapping 19 and straps 17 should be particularly durable.

The teaching of the invention is basically a lawn furniture covering which attaches to the furniture and which may be converted into a container. The side pockets may be made larger either to hang over the arms of the chairs or simply to make a larger container. While FIG. 8 shows a bi-fold chair in the container 65, the general idea obtains for tri-fold chairs and cots, requiring only that their coverings include excess material at sides, top and bottom and the arrangement of fasteners 20 on the durable side 35 of the pockets as shown in FIG. 6 or simply eliminating the pockets.

Rucksack straps may be attached rather than handles 37 or over-the-shoulder straps 17. The size and shape of containers 60 and 65 depend only upon the length and placement of fasteners 20. Pockets 15 are not necessary to the assembly of container 65 shown in FIG. 8. Pockets 15 while shown as being open for easy access to tanning lotion, watch, jewelry, sunglasses, books, cigarettes, comb, etc. may be zipped, snapped or otherwise fastened shut. All fasteners, straps and strapping can be reinforced where they are sewn or secured to the covering to prevent tearing out of the fasteners.

Obviously, numerous modifications and variations of the present invention are possible in the light of the above teachings. It is, therefore, to be understood that within the scope of the appended claims, the invention may be practiced otherwise than as specifically described therein.

What is claimed as new and desired to be secured by Letters Patent of the United States is:

1. A lawn furniture covering to be spread on lawn furniture for a person to lie on and for forming a tote container when it is not on said lawn furniture, said covering comprising:

an elongated, substantially rectangularly shaped, sheet of cloth material for covering supporting surfaces of said lawn furniture upon which said person rests, said sheet having a body-receiving side on which said person lies and a durable side which faces the outside when said covering is configured to form said tote container;

means mounted on said sheet of cloth material for attaching said covering means to said supporting surfaces of said lawn furniture with said durable side being against said supporting surfaces and said body-receiving side facing a person resting on said sheet of cloth material; and attaching means attached to said sheet of cloth material along elongated, approximately parallel side edges thereof for coupling a portion of each of said side edges together with another portion of the same side edge whereby the ends of said elongated sheet of cloth material can be folded toward one another to form a container and the elongated side edges thereof can be coupled to themselves by said attaching means to retain said covering in said container configuration for converting said covering into said tote container, said covering further including pocket flaps flexibly attached to said side edges of said elongated, substantially rectangular, sheet of cloth material and extending outwardly therefrom when said covering is laid flat but hanging down when said covering is lying on lawn furniture, said pocket flaps each having a pocket therein for storing items within reach of one using said lawn furniture, said pocket flaps further having attaching means mounted along side edges thereof which extend laterally to the elongated side edges of said elongated, substantially rectangular sheet of cloth material whereby the side edges of said flaps can be attached to the adjacent elongated side edges of said rectangular sheet of cloth material to thereby couple each of said portions of each of said side edges together with the respective other portion of the same side edge by means of a pocket flap and thereby retain said covering in said container configuration, said pocket flaps forming walls of said container.

2. The covering of claim 1 wherein said attaching means are zippers whose slides move from intersections of the side edges of the pocket flaps with the side edges of the elongated, substantially rectangular sheet of cloth material so that they can be zipped up to attach these edges and thereby form said container.

3. The covering of claim 1 wherein is further included a spacing material for attaching said pocket flaps to said elongated, substantially rectangular sheet of cloth material to thereby allow said pocket flaps to be hung from the armrests of lawn furniture on which said cover is placed.

4. The covering of claim 3 wherein is further included an additional attaching means for allowing said spacing material to be gathered and said pocket flap to be attached directly to said elongated, substantially rectangular sheet of cloth.

5. The covering of claim 1 wherein the body-receiving side of said elongated, substantially rectangularly-shaped sheet of cloth material is soft and absorbent while the other side is harder and more durable.

6. The covering of claim 1 further including carrying means attached to said covering means on the durable side of said sheet of cloth material, for allowing easy handling and transporting of said covering means when it is converted to a container.

7. The covering of claim 6 including stiffening means attached to said elongated substantially rectangular sheet of cloth material near the area of attachment of said elongated, substantially rectangular sheet of cloth material to said pocket flaps, said stiffening means providing shape to said tote container converting from said covering means.

8. The covering of claim 1 wherein said elongated, substantially rectangular sheet of cloth material includes two plys, one moisture-absorbent ply and one more durable ply.

9. The covering of claim 1 wherein said covering means includes two plys, one ply which reflects light and one more durable ply.

* * * * *